United States Patent [19]

Craig

[11] Patent Number: 4,895,348

[45] Date of Patent: Jan. 23, 1990

[54] BACK TENSION DEVICE FOR WINCHES

[75] Inventor: Thomas M. Craig, Midlothian, United Kingdom

[73] Assignee: MacTaggart Scott (Holdings) Ltd., Midlothian, Great Britain

[21] Appl. No.: 207,713

[22] Filed: Jun. 16, 1988

[30] Foreign Application Priority Data

Jun. 20, 1987 [GB] United Kingdom ..... 8714493

[51] Int. Cl.[4] ..... B66D 3/04

[52] U.S. Cl. ..... 254/391; 254/269

[58] Field of Search ..... 254/269, 333, 334, 335, 254/336, 338, 391, 396, 395, 398, 417; 188/83, 65.1; 200/61.18; 242/149, 151

[56] References Cited

U.S. PATENT DOCUMENTS

| | | | |
|---|---|---|---|
| 2,174,828 | 10/1939 | Latocha | 188/65.1 X |
| 2,230,940 | 2/1941 | Ellsworth | 254/336 X |
| 2,487,889 | 11/1949 | Moore | 242/149 X |
| 2,756,947 | 7/1956 | Arnold | 242/151 |
| 4,271,763 | 6/1981 | Berger | 200/61.18 X |
| 4,746,100 | 5/1988 | Davenport | 188/83 X |

FOREIGN PATENT DOCUMENTS

| | | | |
|---|---|---|---|
| 1142223 | 1/1963 | Fed. Rep. of Germany | 254/335 |
| 255198 | 6/1948 | Switzerland | 254/336 |

*Primary Examiner*—Katherine A. Matecki
*Attorney, Agent, or Firm*—Stephen G. Rudisill

[57] ABSTRACT

The invention relates to a back tension device for a winch and comprises a freely rotatable pulley having associated therewith a pivotable tensioning element which is adapted to be urged into engagement with a cable from the winch so as to apply a back tension thereto during the hauling mode. Such tensioning assists in correct winding of the cable on the winch drum.

6 Claims, 4 Drawing Sheets

BACK TENSION DEVICE FOR WINCHES

BACKGROUND OF THE INVENTION

1. Field of the Invention

This invention relates to a back tension device for winches.

2. Description of the Related Art

Winches using flexible steel wire rope are used extensively throughout many different industries. Such winches comprise a drum capable of rotation in order to wind cable on to a drum (hauling) or to pay cable off the drum (veering). It is important to store the cable neatly on the drum in order to make use of the storage capacity of the drum and also to prevent excessive flange loads; if cable is incorrectly and slackly wound on to the drum and a heavy load is experienced by the cable, it is possible to "out through" the loosely-spooled coils or cable and as a result, the cable can get locked into these coils. This causes damage to the rope and in certain cases, the rope may have to be cut off the drum and discarded.

SUMMARY OF THE INVENTION

An object of the present invention is to provide means for assisting in ensuring that the cable is wound correctly on to the winch drum when in the hauling mode. A further object of the invention is to prevent the formation of slack turns of cable on the drum during the veering mode.

According to the present invention there is provided a back tension device for a winch comprising a freely-rotatable pulley adapted to be mounted adjacent a winch drum; an arm mounted on said pulley for pivotal movement about an axis spaced from the axis of rotation of the pulley; means for ensuring limited pivotal movement of the arm on rotation of the pulley; and means on said arm adapted to be urged into engagement with the cable passing around said pulley on said limited pivotal movement of the arm in order to apply a back tension to the cable.

Preferably, the roller is provided with means for restraining said roller against free rotation thereof.

BRIEF DESCRIPTION OF THE DRAWINGS

An embodiment of the invention will now be described, by way of example, with reference to the accompanying drawings, in which.

DESCRIPTION OF THE PREFERRED EMBODIMENTS

Figure 1:
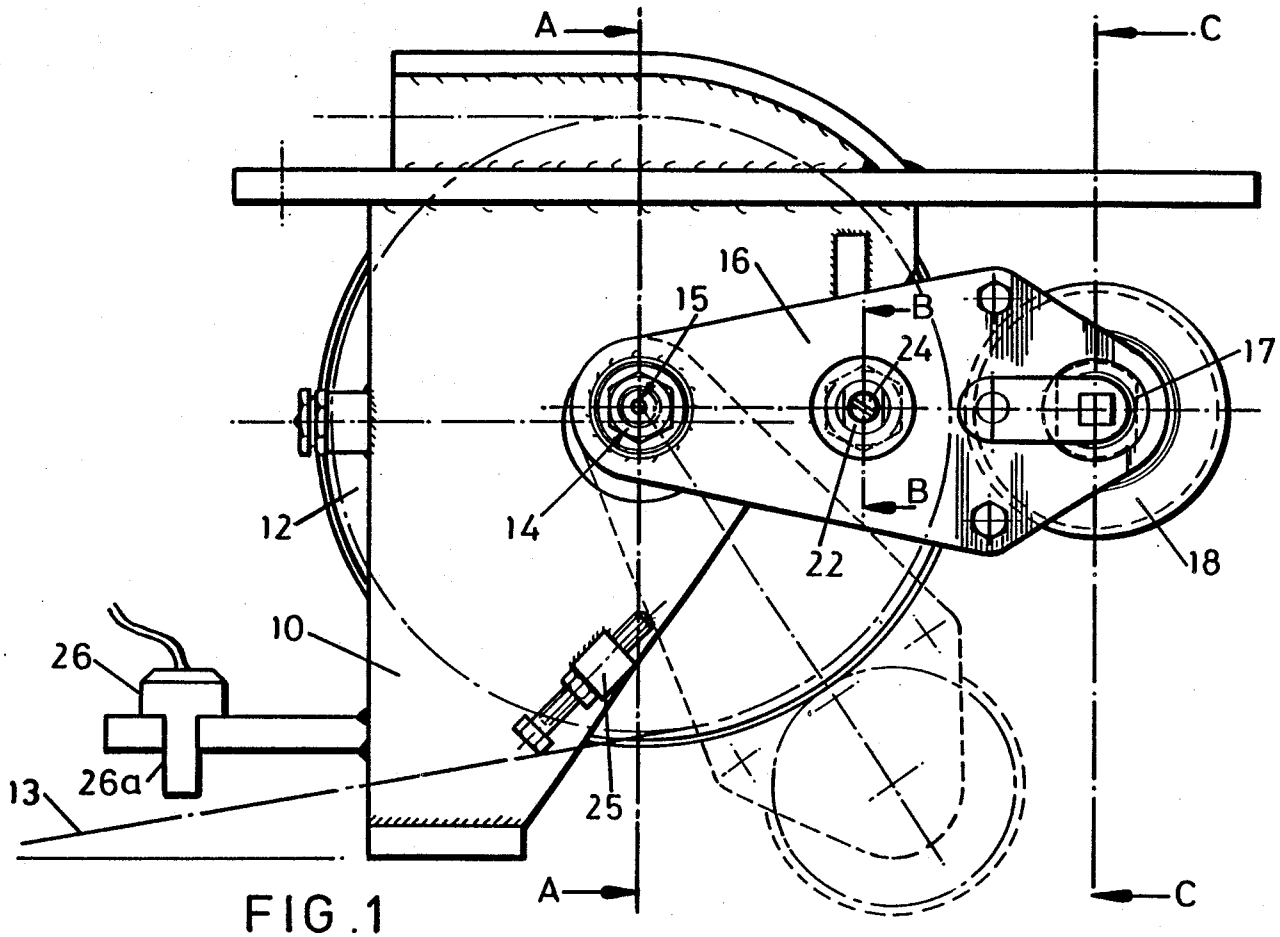
FIG. 1 is a front view of a back tension device for a winch in accordance with the present invention.
Figure 2:
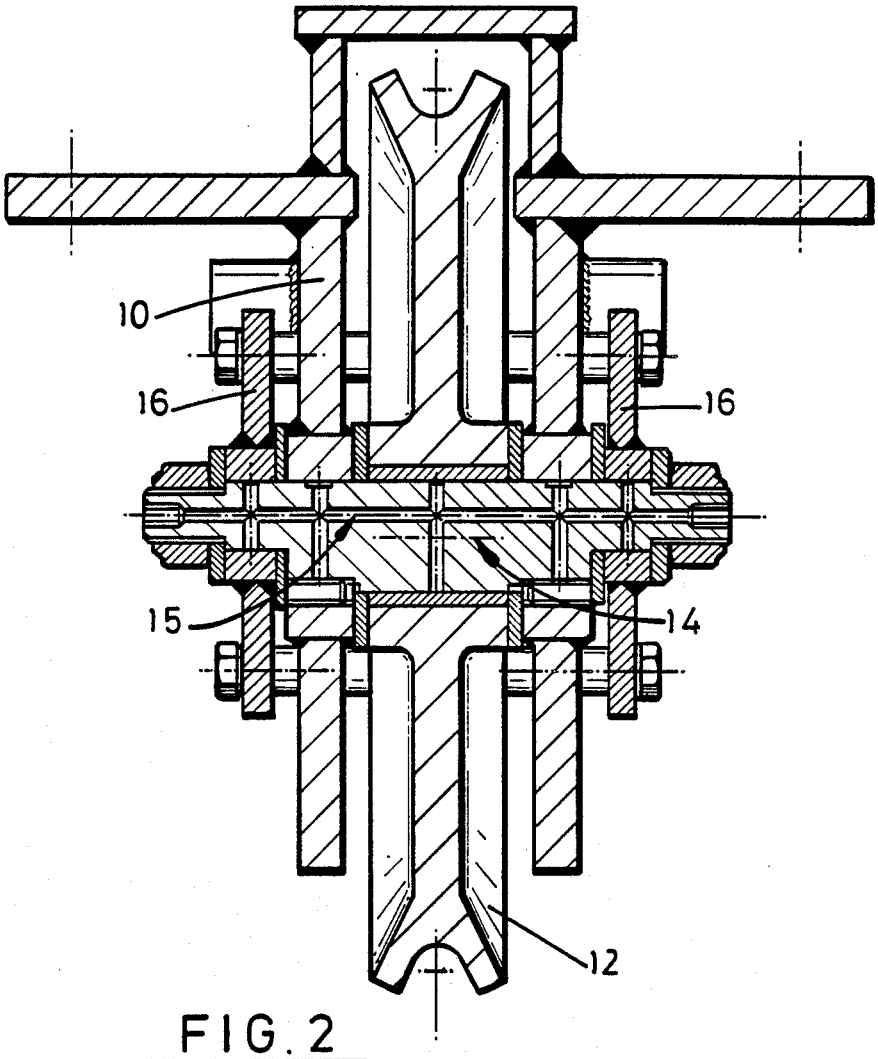
FIG. 2 is a sectional view on the line B—B of FIG. 1.

Referring to the drawings, a back tensioning device for a winch comprises a frame member 10 which is adapted to be mounted in any suitable operative relationship to a winch (not shown). The frame member 10 carries a freely rotatable grooved pulley 12 around which a wire cable 13 extends from the winch. The pulley 12 is rotatably carried by the member 10 by means of a pulley shaft or like arrangement and is rotatable about an axis of rotation 14.

Mounted about the pulley shaft for arcuate movement relative to the pulley about an axis 15 is a bifurcated arm 16 extending along both sides of the pulley

Figure 4:
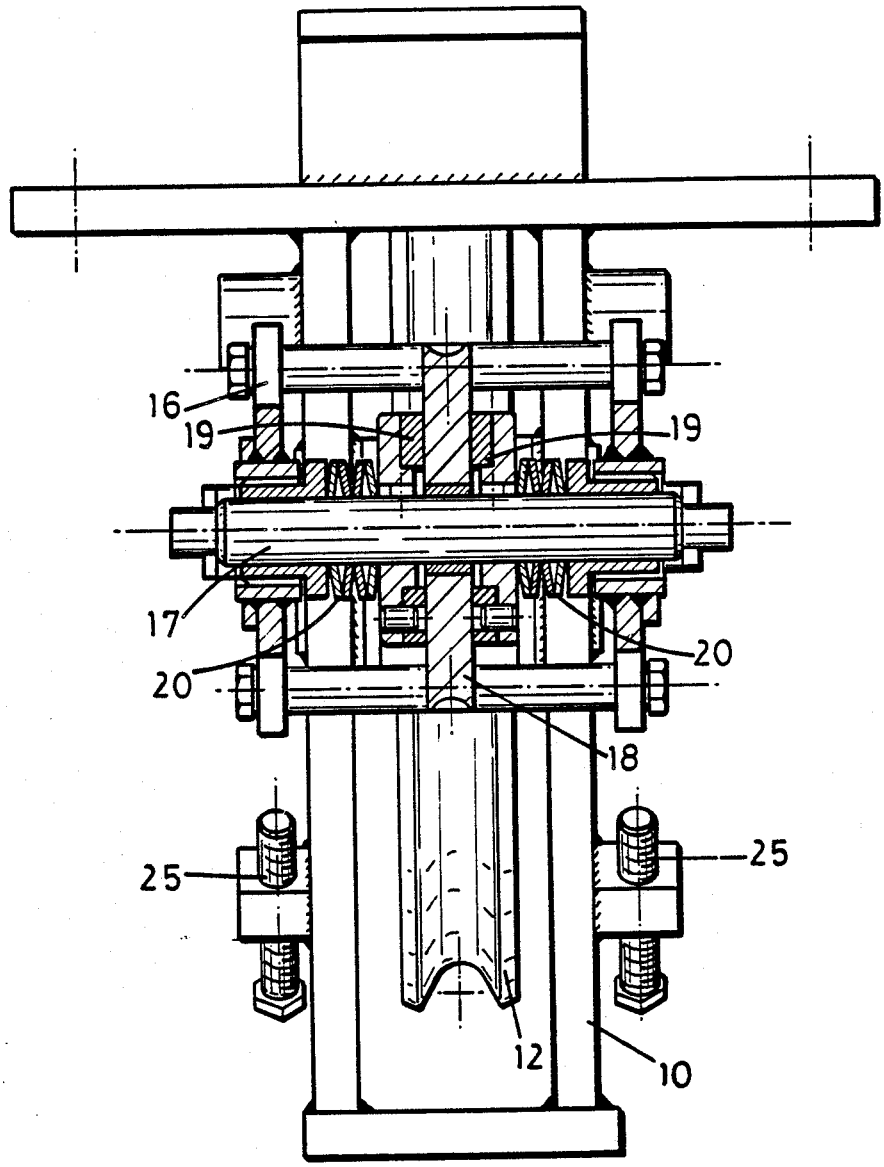
FIG. 4 is a sectional view on the line C—C of FIG. 1.

12. The arm 16 can pivot about the axis 15 which is offset relative to the axis of rotation 14 of the pulley 12, i.e., the axes of rotation of the pulley 12 and the arm 16 are eccentric relative to each other. The outer end of the arm 16 carries on an axle 17 a grooved friction roller 18. On either side of the side faces of the roller 18 and also mounted on the axle 17 are a pair of friction pads 19 (FIG. 4) which can be urged by means of springs 20 into engagement with the side faces of the friction roller 18 so that the roller 18 can only be rotated on the application of sufficient torque to overcome the resistance of rotation created by the friction pads 19. The extent of required torque can be preset.

Figure 3:
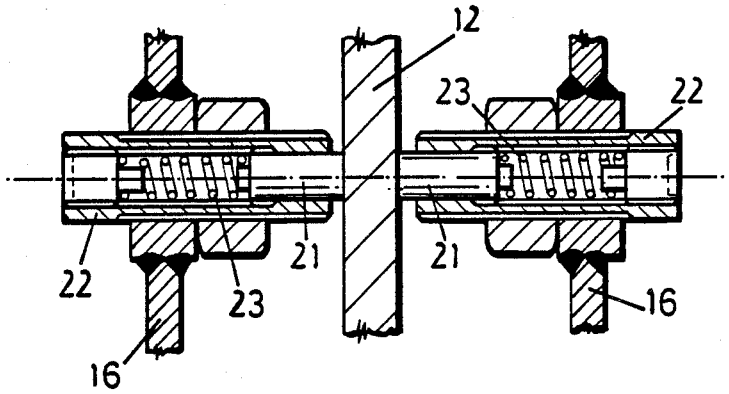
FIG. 3 is a part sectional view on the line B—B of FIG. 1.

Intermediate ends of the arm 16 there is provided a pair of friction elements 21 (FIG. 3) which are slidably mounted in sleeves 22 carried by each leg of the bifurcated arm 16. The friction elements 21 extend inwardly to engage each lateral face of the pulley 12 and are urged into engagement therewith by associated coil springs 23. The pressure exerted on the friction elements 21 can be varied by adjustment of control screws 24.

Mounted on the frame member 10 is a pair of adjustable stop members 25 for limiting the angle through which the arm 16 can travel. Also mounted on the frame 10 is an electrically operated proximity switch 26, the operative component **26*a* of the proximity switch being positioned adjacent the wire cable from the associated winch drum prior to its passage around the pulley 12**.

In operation of the back tension device and during hauling mode of the cable on to the winch drum, the cable is fed around the pulley 12 as indicated in FIG. 1 and between the pulley 12 and the friction roller 18. When the cable is hauled, the pulley 12 is rotated clockwise as shown in FIG. 1. Due to the engagement of the friction elements 21 with the pulley 12, the arm 16 and its associated roller 18 is rotated with the pulley 12 until the friction roller 18 is pulled into contact with the cable on the pulley 12 due to the eccentric mounting of the arm 16, so that the roller 18 is pressed heavily into the groove of the pulley 12. The roller 18 is restrained against free rotation by pads 19 until the cable 13 passing round pulley 12 applies sufficient torque to cause the roller 18 to rotate. Due to the reaction of the friction roller drag, a back tension will be imparted to the cable 13 which back tension is a pre-requisite for good spooling.

When the cable is to be veered from the winch drum, the cable 13 is first lightly tensioned by hand and the winch drum is rotated in the appropriate direction. Tension in the cable 13 will cause the pulley 12 to rotate in counterclockwise direction (as seen in FIG. 1). The action of the friction elements 21 between the pulley 12 and the roller mounting arm 16 will cause the arm 16 to rotate with pulley 12. As a result, the friction roller 18 will be moved out of engagement with the cable 13 around the pulley 12 and no induced drag will be present. If, however, there is no manually applied tension to the cable 13, the cable would tend to be paid off the drum and thus induce slack turns of cable on the winch drum. If this happens, the cable 13 drops from the tensioned position as illustrated in chain dot lines in FIG. 1 to a slack position as shown in dashed line. In this condition, the electrically operated proximity switch 26, which operates in relation to the proximity of the wire cable 13, operates to cause rotation of the winch drum to cease. In order to maintain the proximity switch 26 in an active mode, therefore, tension must be applied to the cable 13.

It has been found that the back tension device, as described above, has been effective in the effective and neat spooling of wire cable on to a winch drum when in the hauling mode and at the same time the occurrence of slack coils on the winch drum in the absence of inadequate back tension is prevented.

Although in the above-described embodiment, friction is applied to the roller 18 by means of the friction pads 19, it has been found that the presence of such friction pads is desirable but not essential. In addition, means other than the friction elements 21 can be employed for bringing the roller 18 into engagement with the cable on the main pulley 12. For example, the roller 18 can be provided with a counterweight or be spring-loaded in order to urge it into operative engagement.

I claim:

1. A back tension device for a winch for carrying cable, said device comprising a freely-rotatable pulley around which the cable is wound, said pulley adapted to be mounted adjacent a winch drum; an arm pivotally mounted about said pulley for pivotal movement about an axis which is offset relative to the axis of rotation of the pulley; means for effecting limited pivotal movement of the arm in response to rotation of the pulley; and means on said arm for engaging the cable wound around said pulley and urging the cable against the pulley when said limited pivotal movement of the arm is effected, in order to apply a back tension to the cable.

2. A back tension device as claimed in claim 1, in which the means for effecting said limited pivotal movement of the arm comprises friction means extending between the arm and the pulley and operational to cause limited rotational movement of the arm with the pulley.

3. A back tension device as claimed in claim 2, in which the friction means comprises at least one friction element on the arm urged into engagement with the pulley by spring means.

4. A back tension device as claimed in claim 1, in which the cable-engaging means on the arm is a grooved roller.

5. A back tension device as claimed in claim 4, in which the grooved roller is provided with meas for restricting rotation of the roller until a predetermined torque is applied thereto.

6. A back tension device as claimed in claim 1, further comprising an electrically-operated proximity switch for sensing the proximity of the cable from a winch with which the device is being used and being operative to cut off the drive to the winch when the tension in the cable falls below a predetermined value.

* * * * *